United States Patent [19]

Maples

[11] 4,282,737

[45] Aug. 11, 1981

[54] HAND OPERATED BENDING APPARATUS AND METHOD FOR METAL BAR, TUBING AND THE LIKE

[76] Inventor: Billy G. Maples, 65 Dale Rd., Middletown, N.J. 07748

[21] Appl. No.: 132,823

[22] Filed: Mar. 24, 1980

[51] Int. Cl.[3] ..... B21D 7/03

[52] U.S. Cl. ..... 72/388; 72/32; 72/310; 72/369

[58] Field of Search ..... 72/388, 387, 32, 214, 72/215, 216, 217, 310, 319, 369, 149

[56] References Cited

U.S. PATENT DOCUMENTS

| | | | |
|---|---|---|---|
| 361,523 | 4/1887 | Jeffery | 72/215 |
| 1,349,219 | 8/1920 | Moore | 72/387 |
| 2,565,646 | 8/1951 | Boyer | 72/211 |
| 4,055,065 | 10/1977 | Whetstone | 72/217 |
| 4,167,865 | 9/1979 | Powell | 72/217 |

*Primary Examiner*—Gene P. Crosby
*Attorney, Agent, or Firm*—Patrick J. Pinto

[57] ABSTRACT

A hand operated bending apparatus is provided for the bending of metal such as tubing and bar by the application of a force to a sweep lever arm cooperating with a preset pivoted force link, thereby urging the metal to follow the contour of a forming die and automatically terminating the bending action at a preset point by the disengagement of the force link from the metal bar.

13 Claims, 10 Drawing Figures

HAND OPERATED BENDING APPARATUS AND METHOD FOR METAL BAR, TUBING AND THE LIKE

BACKGROUND OF THE INVENTION

Description of the Prior Art

Hand-operated bending apparatus using a sweep arm is well known. There are many patents disclosing the use of a sweep arm cooperating with either a fixed or rotating shoe to urge the metal to be bent against a forming die. Most of the existing apparatus requires the clamping of the metal in order to prevent movement of the metal bar during the bending operation. Scoring or marking the metal is another problem that has occurred in bending metal when using existing apparatus. It has been found that prior art patents require a considerable amount of force to bend tubing having a medium to thick gauge wall when heat has not been applied to the metal.

The present invention provides a relatively simple, light-weight and inexpensive bending tool which effectively and accurately bends metal while requiring less force on the part of the operator.

SUMMARY OF THE INVENTION

This invention may be summarized, at least in part, with reference to its objects.

It is an object of this invention to provide, and it does provide, a hand-operated metal bending tool which will bend metal accurately and repeatedly without marking or scoring its surface.

It is a further object of this invention to provide, and it does provide, a hand-operated metal bending tool which is lightweight and inexpensive in construction.

It is another object of this invention to provide, and it does provide, a hand-operated metal bending tool which requires less operator effort in bending medium gauge tubing.

It is still another object of this invention to provide, and it does provide, a hand-operated metal bending tool which automatically terminates the bending action at a preset degree of bend.

It is still a further object of this invention to provide, and it does provide, a hand-operated metal bending tool which provides means for gauging the length of metal needed in bending said metal to a required degree.

In brief, a hand-operated bending tool for metal, such as tubing and/or bar, to be more fully described, includes a base member which may be fastened to a work table, or clamped in a vise; a forming die removably secured to the base member; guide means on said base member to align the metal bar and/or tube with the forming die; a sweep lever arm having one end pivotally mounted to substantially the center of the forming die; a grasping means at its other end; a force link pivotally secured intermediate the length of the sweep arm at one end and having a tube guide means at its distal end for gauging the length of the metal bar and/or tube and applying the bending force to the metal.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a hand-held and operated metal bending apparatus as adopted for use in bending a bar and/or tube and showing a preferred means for making said bends. This specific embodiment has been chosen for the purposes of illustration and description as shown in the accompanying drawing wherein:

BRIEF DESCRIPTION OF THE DRAWING

FIG. 7D is a plan view depicting the fourth in the series of views of the bending action, and showing the force link swinging past alignment with the sweep lever arm as the sweep lever arm is rotated further than required to complete the desired degree of bend of the bar, tube, and the like.

DESCRIPTION OF THE PREFERRED EMBODIMENT

Figure 1:
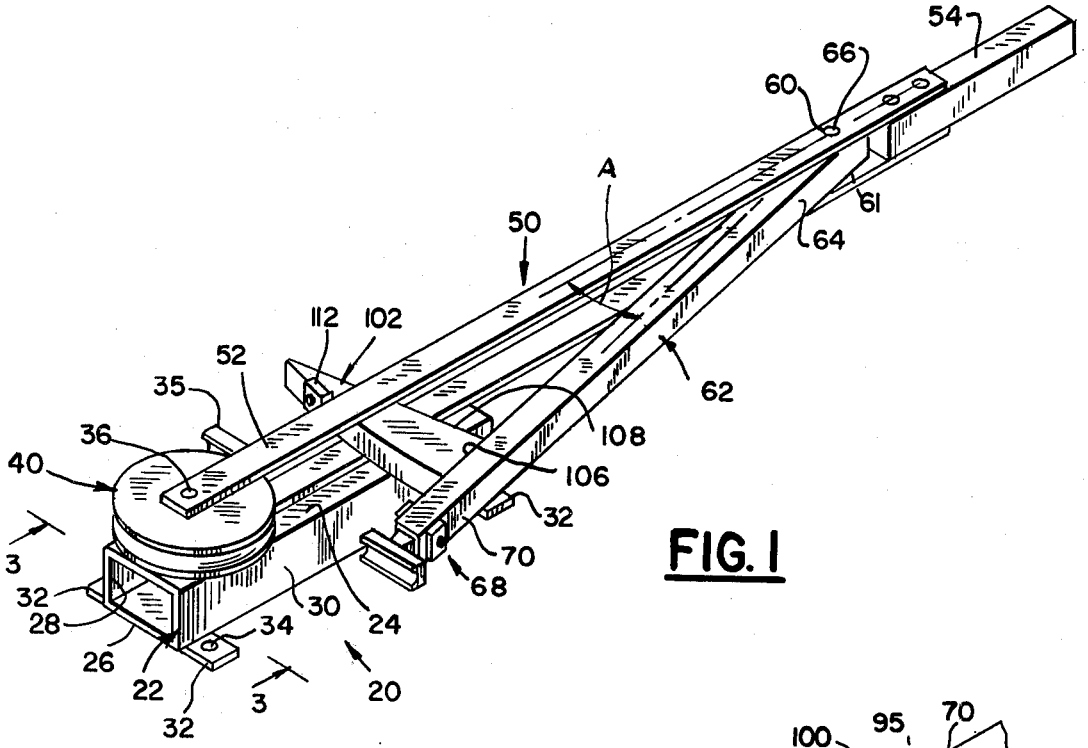
FIG. 1 is a perspective view of the hand-operated metal bender showing the force link in an extended condition.
Figure 3:
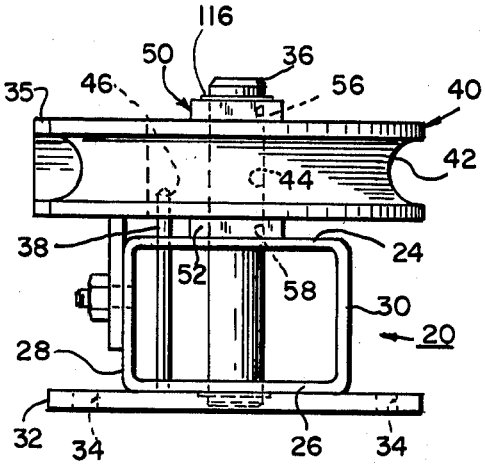
FIG. 3 is a side view taken along the line 3—3 of FIG. 1 and showing the mounting of the forming die on the base member.

Referring to the drawing and in particular to FIGS. 1 and 3, a base member, generally shown as 20, has a substantially elongated, tubular body 22 having a top 24, a bottom 26 and first and second sides 28 and 30 respectively. A plurality of mounting feet 32 are secured to the bottom 26 of the body 22. Holes 34 are formed in the mounting feet for attaching the base member to a worktable or the like. A first guide member 35 is adjustably secured to the body 22 at its first side 28. A post member 36 is fastened to the body 22 and extends a predetermined length above the body top 24. A pin 38 is also secured to and extends from the body top at a selected position.

A forming die, generally shown as 40, may be described as disk-like and has a shaped peripheral surface 42 adapted to accept the article to be formed or bent.

This die has a through hole 44 sized to fit closely onto and over the post member 36. A second hole 46 in die 40 is sized to fit onto and over pin 38 to a act as an antirotation device.

A sweep lever arm, generally shown as 50, has an end 52 and a grasping end 54. Through holes 56 and 58 are formed in the end 52 to fit closely and rotatably on post member 36 while this end 52 straddles the forming die 40. A second pair of through holes 60 and 61 are formed intermediate the length of the sweep lever arm 50.

A force link, generally shown as 62, is pivotally mounted at one end 64 to the sweep lever arm 50 at holes 60 and 61 by pin 66 which is secured to the force link 62. A bending guide, generally shown as 68, is located at the distal end 70 of the force link 62.

Figure 2:
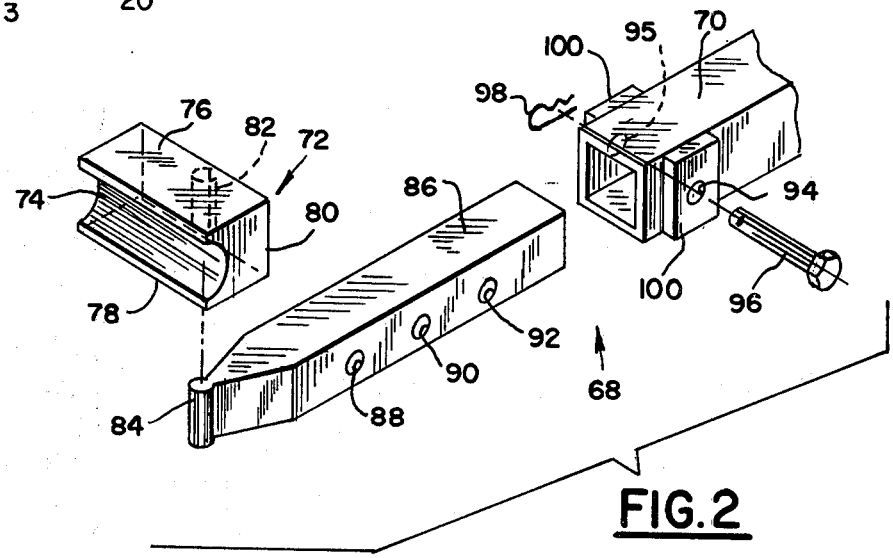
FIG. 2 is an exploded isometric drawing of the bending guide along with its mounting bar telescoped within the force link.

Bending Guide of FIG. 2

Referring to the drawing, and in particular to FIG. 2, the bending guide 68 is shown in more detail. The bending guide shoe 72 has a shaped face 74 adapted to accept the article to be bent, a top 76, a bottom 78 and a back surface 80 and two sides. A cylindrical shaped undercut recess 82, which as depicted is elongated and slotted, is formed into the back surface 80 of the guide shoe 72. This shoe is fitted closely to the cylindrical mating end portion 84 of a telescoping bar 86. Said telescoping bar 86 is sized to fit into the hollow distal end 70 of the force link 62. Through holes 88, 90 and 92 are provided in the telescoping bar 86 to align and mate with a pair of in-line through holes 94 and 95 in the distal end 70 of the force link 62 and are held in position by pin 96 and clip 98. Reinforcing pads 100 may be provided on the force link 62.

Figure 4:
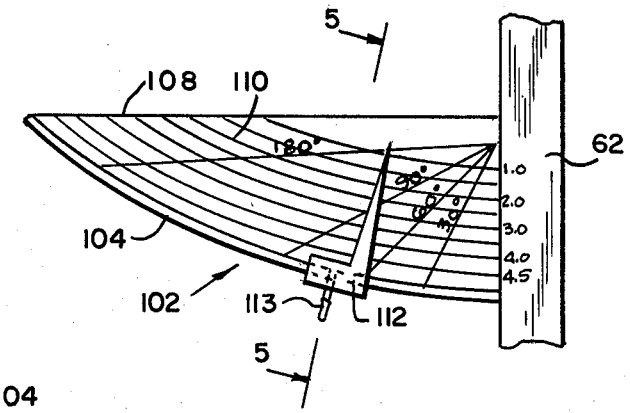
FIG. 4 is a plan view of the bending angle gauge plate and a stop bar.
Figure 5:
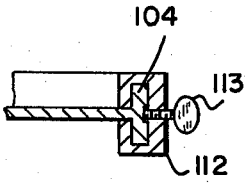
FIG. 5 is a fragmentary sectional view taken along the line 5-5 of FIG. 4 and showing the clamping of a stop block to a bending gauge.

Referring now to FIGS. 1, 4 and 5, a bending angle gauge, generally shown as 102, has a first radial side 104, a second side 106 and a third side 108. The bending angle gauge 102 is secured at side 106 to the force link 62 at a point intermediate the length of the force link. A scale 110 is provided to set a selected included angle indicated as "A" between the sweep lever arm 50 and the force link 62 for the selected bend radii for the degree of bend. A stop block 112 is slidably mounted to the first radial side 104 of the bending angle gauge 102 and has a suitable clamping means, shown generally as 103, to maintain the selected adjustment.

Figure 6:
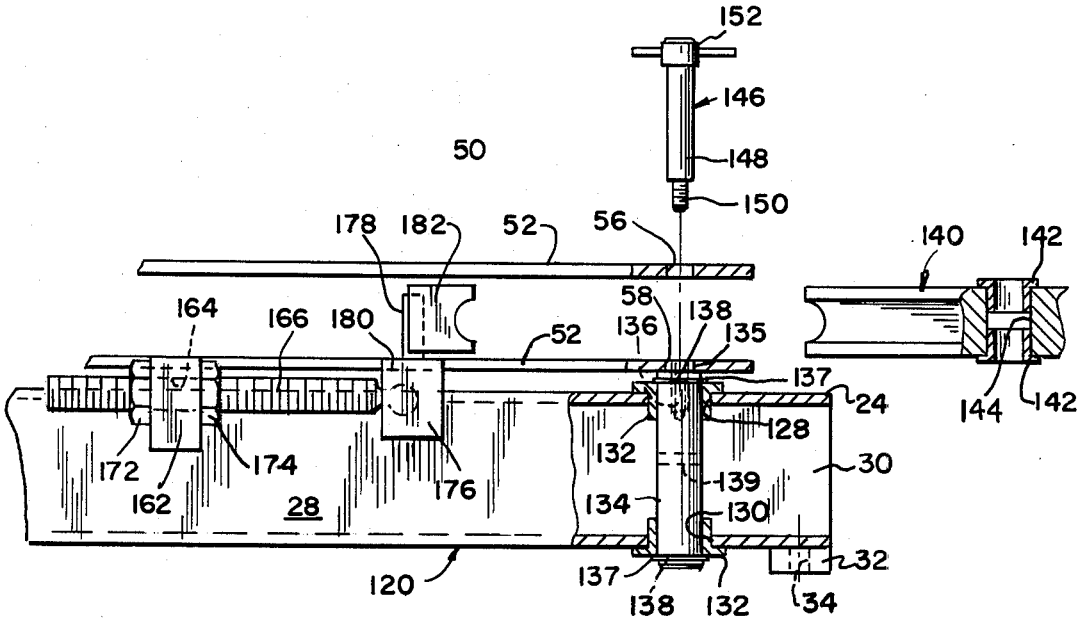
FIG. 6 is a side elevational view, partially cut away, of an alternate embodiment of the hand-operated metal bender showing in particular the securing means for the forming die and an adjustment means for a first guide means.

Alternate Embodiment of FIG. 6

Referring to the drawing and in particular to FIG. 6, a base member generally shown as 120 is very similar to base member 20 including top 24 and bottom 26. Holes 128 and 130 are formed in-line through top 124 and bottom 126. Flanged bushings 132 are pressed into holes 128 and 130 with their flanged portions opposed to each other. A shaft 134 has a shoulder portion 135 and female threads 136 formed in the center of the shaft at the shouldered portion 135. The shaft is captivated to the base member by retaining rings 137 engaging grooves 138 in the shaft 134. A hole 139 is cross-linked mid-length the shaft 134.

A forming die 140 similar to and having all the features as the forming die 40 is provided additionally with flanged bushings 142 pressed in from each end of a central through hole 144.

A tee-handled bolt 146 has a shouldered body 148, a threaded portion 150 and a head portion 152. The forming die 140 and sweep arm 50 are removably secured to the base member and shaft assembly by inserting the tee-handled bolt 146 through upper hole 56 in the sweep arm 50, then through bushings 142 in the forming die, and then hole 58 in the sweep arm 50 and finally threading the tee-handled bolt into the female threads 136 of the shaft 134. Hole 139 may be used by inserting a pin or rod into said hole in order to hold the shaft 134 while tightening the tee-handled bolt 146. Disassembly for any purpose including the change over of a forming die 140 is a reverse of the above assembly procedure.

Alternate First Guide Means As Seen in FIG. 6

Referring to FIG. 6, a first guide means generally shown as 160 has a mounting block 162 secured to a base member 20 or 120 by welding or the like. A through hole 164 is formed and sized in the mounting block 162 to accept an adjusting rod 166 in body fit relationship.

Threaded nuts 172 and 174 secure the adjusting rod 166 in a left to right relationship to the mounting block 162. A slide block 176 secured to the adjusting rod 166 slidably engages the top 24 and side 28 of the base member 20 or 120. A post 178 extends from the top surface 180 of the slide block 176 to accept a guide shoe 182, similar in construction to guide shoe 72.

Use and Operation of the Alternate Guide Means

When it is desired to move the guide means 160 rightwardly, the nut 172 is loosened and moved leftward or away from the mounting block 162 a given distance. The nut 174 is rotated causing the guide shoe means 160 to move rightwardly until the proper adjustment is attained. Nut 172 is then rotated until it engages the mounting block 162 and tightened. The above instructions are reversed to move the guide shoe means leftwardly.

Apparatus of FIGS. 7A, 7B, 7C, 7D

Figure 7D:
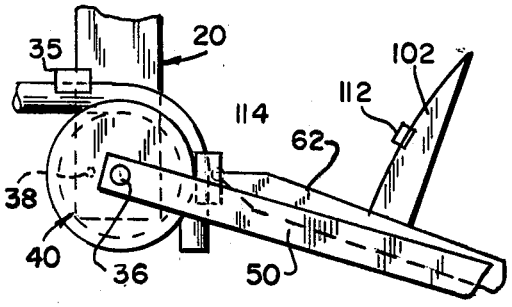
Figure 7A:
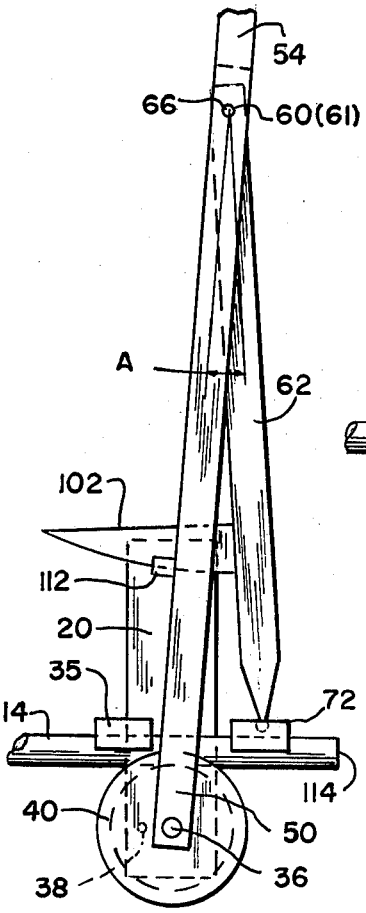
FIG. 7A is a plan view depicting the first in a series of views, partially schematic, and showing the action of the bending tool during the bending of a length of metal bar, tube and the like, this view showing a force link swung from alignment with a sweep lever arm and engaging a length of bar, tube and the like inserted in the tool.
Figure 7B:
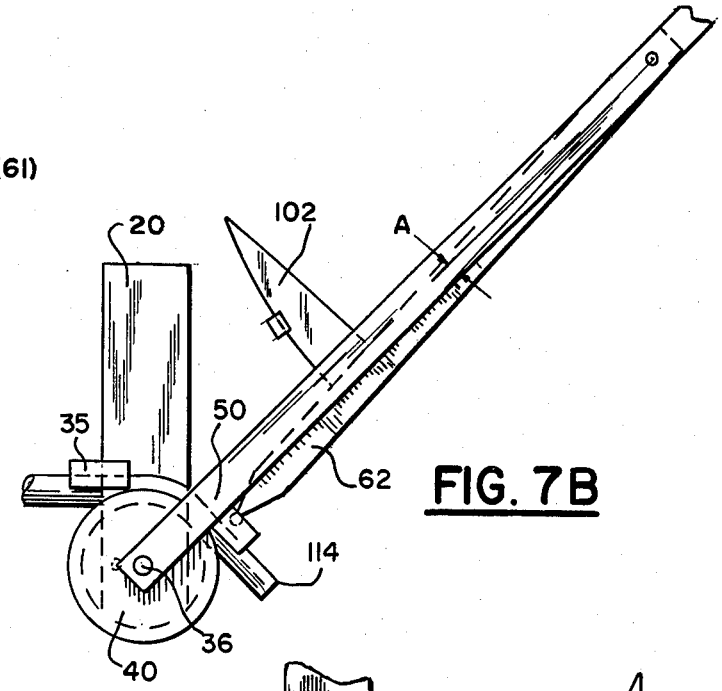
FIG. 7B is a plan view depicting the second in the series of views of the bending tool, and showing the bending action about halfway through a desired degree of bend.
Figure 7C:
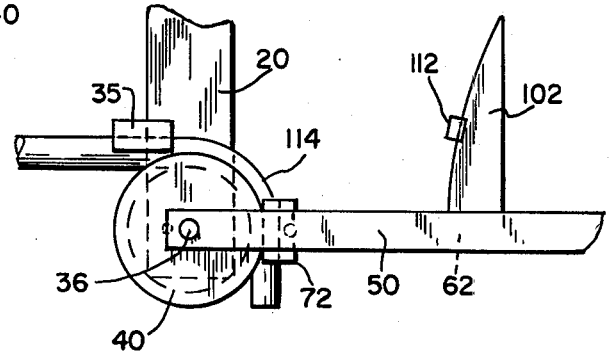
FIG. 7C is a plan view depicting the third in a series of views showing the metal bending tool at the completion of the bending operation and showing the force link and the sweep lever arm in alignment with each other.

Referring to FIGS. 7A, 7B, 7C and 7D, a length of metal bar 114, such as medium wall steel tubing, is positioned in the apparatus by inserting the length of the bar through the first guide member 35 and along side and in alignment with the forming die 40. A degree of bend is selected on the bending angle gauge 102 and the stop block 112 is positioned as in FIG. 7A. The force link 62 is swung as far as the stop block 112 will allow forming an included angle "A" between the force link 62 and the sweep arm 50. The tubing or bar 114 is then aligned with the bending guide 68 with as much tubing or bar as desired extending past the end of the bending guide shoe 72. Grasping and moving end 54 of the sweep lever arm 50 in a clockwise direction causes the force link 62 to apply a bending force to the metal tubing or bar 114. As the sweep lever arm 50 is rotated clockwise about the forming die 40 the included angle indicated as "A" is progressively reduced to zero degree at such time the degree of bend of the metal bar or tubing 114 is completed. When the included angle has been reduced to zero degree the force link 62 is in alignment with the sweep lever arm 50, as shown in FIG. 7C. Further movement of the sweep lever arm 50 causes the force link 62 to travel past the zero point or alignment with the sweep lever arm 50 as shown in FIG. 7D. The force link now ceases to apply a bending force to the metal bar or tubing.

In FIG. 2 it is to be noted that holes 88, 90 and 92 are provided as a quick adjustment means for various bend radii. Although three are shown, more-or-less holes may be provided to suit a particular application and range.

It is contemplated that various forming dies 40, guide members 35 and bending guide shoes 72 will be provided as metal bar size and bend radii requirements are changed. Adjustment of the guide means has been previously disclosed for change of the bend radii. As tube or bar size is changed, the guide shoe 72 is easily removed from its cylindrical mating portion 84. A similar arrangement is provided for first guide member 15. The forming die 40 is changed by removing the sweep lever arm 50 and forming die assembly, removing the form die from the assembly and inserting a new forming die in the assembly and reassembling the tool in reverse order.

As a method, the above apparatus for bending a metal bar, tube, and the like provides the novel steps of:

inserting the metal bar, tubing and the like into a bending apparatus.

aligning the metal bar with a first guide means and a forming die having a determined radii selecting an included angle between a pivotally mounted sweep lever arm and a force link, said force link carrying a second guide means at its distal or free and;

engaging the metal bar, tubing and the like with said second guide means;

rotating the sweep lever arm pivotally around the substantial center of the forming die and in the direction of the bend, wherein said included angle is progressively reduced to zero angle and the second guide means disengages from the metal bar.

The bending tool is contemplated to be constructed of steel products, readily available, thereby reducing the cost of manufacture.

Terms such as "left", "right", "up", "down", "bottom", "top", "front", "back", "in", "out" and the like are applicable to the embodiment shown and described in conjunction with the drawings. These terms are merely for the purpose of description and do not necessarily apply to the position in which the apparatus and method of bending metal bar and the like may be constructed or used.

While a particular embodiment of this apparatus for the bending of metal bars and alternate embodiments have been shown and described it is to be understood the invention is not limited thereto since modifications may be made within the scope of the accompanying claims and protection is sought to the broadest extent the prior art allows.

What is claimed is:

1. Apparatus for a hand-operated bending of metal bars and/or tubing, said bending being automatically terminated when and as the bending reaches a preselected arc point, this apparatus including:

(a) a base member providing means for mounting said base member to a worktable, vise and the like;

(b) a forming die removably secured to and carried by the base member, said forming die having a theoretical center providing a bend radii means for a said metal bar, tubing and the like;

(c) a first guide means removably secured to said base member and providing aligning and retaining means for maintaining said metal bar, tubing and the like in a longitudinal axial position with the forming die preparatory to being bent;

(d) a sweep lever arm having one end pivotally secured to said forming die at an axis which is substantially at the center of a bend radii of and for the bar, tubing and the like being bent;

(e) a force link having one end pivotally carried and mounted in the sweep lever arm, this pivoted end mounted intermediate the extent of said sweep lever arm, a distal end of said force link having a second guide means adapted to engage said bar, tubing or the like prior to the bending of said bar, tubing and the like, wherein the distal end of the force link is swung from an included angle of zero degrees or alignment with said sweep lever arm a selected amount, to form an included angle between the force link and the sweep lever arm, and at this time the second guide means engages the bar, tubing or the like along a longitudinal extent;

(f) means for grasping and rotating the sweep lever arm about the forming die, said rotation progressively reducing the included angle between the force link and the sweep lever arm, so that at the completion of the bend of the bar, tube and the like the distal end of the force link swings to and through an included angle of zero degree and alignment with the sweep lever arm.

2. The apparatus as recited in claim 1 wherein the base member includes an elongated tubular member with substantially vertical sidewalls for clamping in a vise.

3. The apparatus as recited in claim 1 or 2 wherein said base member further includes a plurality of perforated feet extending from said base member for securing to a worktable and the like.

4. The apparatus as recited in claim 1 wherein said forming die includes an anti-rotation means.

5. The apparatus as recited in claim 1 wherein said first guide means includes an adjustment means for adapting said guide means to various bend radii of the forming die.

6. The apparatus as recited in claim 1 wherein the sweep lever has one end furcated for pivotly securing to and straddling said forming die.

7. The apparatus as recited in claim 1 wherein the distal end of the force link further includes an adjustment means for adapting to said forming die bend radii, and means for pivotly securing the second guide means at the distal end of said force link.

8. The apparatus as recited in claim 7 wherein said adjustment means includes:

(a) a tubular force link having a pair of in line holes formed in its distal end;

(b) said tubular force link adapted to receive a telescoping bar, said telescoping bar having a plurality of through holes in spaced relationship sized to mate with said pair of in line holes in the force link;

(c) a pin and a retaining clip for securing the telescoping means to the hollow force link by and through said holes in the force link and telescoping bar.

9. The apparatus as recited in claim 7 or 8 wherein said pivotly securing means for the second guide means further includes:

(a) a cylindrical member formed at the distal end of the force link, said cylindrical member having its longitudinal axis parallel to the pivoting axis of the force link;

(b) a bending guide shoe having a shaped face, a top, a bottom, a back and two sides, and (c) a cylindrical shaped elongated and slotted undercut recess formed into the back surface of the bending guide shoe for mounting and over said cylindrical member.

10. The apparatus as recited in claim 1 or 7 further including a bending angle gauge for selecting the included angle between the sweep lever arm and the force link.

11. The apparatus as recited in claim 10 wherein said bending angle gauge includes:

(a) a first radial side, a second side, a third side and a scale, said second side adapted to be secured intermediate the length of the force link; and (b) a stop block adjustably clamped to said bending angle gauge along said radial side for maintaining the degree of bend selected.

12. The method of bending metal bar, tubing and the like, said bending being automatically terminated when and as the bending reaches a preselected arc, this method including the following steps;

(a) inserting the metal bar, tubing and the like into the bending apparatus;

(b) aligning the metal bar with a fixed first guide means and a forming die having a determined radius;

(c) selecting an included angle between a sweep lever arm and a force link, said force link having a second guide means at its distal or free end;

(d) engaging the metal bar, tubing or the like with said second guide means;

(e) rotating the sweep lever arm pivotally movable around a substantially center of the forming die and in the direction of the bend, wherein said included angle is progressively reduced until the second guide means disengages from the metal bar.

13. The method of bending metal bar, tubing and the like as recited in claim 12 wherein the step of selecting of said included angle includes the further step of clamping a stop block to a bending angle gauge to maintain a setting for repeating said bend on subsequent metal bars.

* * * * *